US008446101B2

(12) United States Patent
Tsui et al.

(10) Patent No.: US 8,446,101 B2
(45) Date of Patent: May 21, 2013

(54) CONTROL SWITCH

(76) Inventors: Gallen Ka Leung Tsui, Brampton (CA); Philip Y. W. Tsui, Brampton (CA)

( * ) Notice: Subject to any disclaimer, the term of this patent is extended or adjusted under 35 U.S.C. 154(b) by 974 days.

(21) Appl. No.: 12/505,694

(22) Filed: Jul. 20, 2009

(65) Prior Publication Data

US 2011/0012528 A1 Jan. 20, 2011

(51) Int. Cl.
*H05B 41/36* (2006.01)

(52) U.S. Cl.
USPC ..... 315/291

(58) Field of Classification Search
USPC ..... 315/291, 74, 73, 246, 306, 307; 307/139, 307/140, 141.8, 143
See application file for complete search history.

(56) References Cited

U.S. PATENT DOCUMENTS

| | | | | |
|---|---|---|---|---|
| 4,521,843 | A | 6/1985 | Pezzolo et al. | |
| 5,895,986 | A | 4/1999 | Walters et al. | |
| 6,133,696 | A * | 10/2000 | Tavares et al. | 315/194 |
| 6,865,428 | B2 | 3/2005 | Gonzales et al. | |
| 7,863,777 | B2 * | 1/2011 | Tsui et al. | 307/139 |
| 8,193,715 | B2 * | 6/2012 | Mehta | 315/194 |
| 2007/0217237 | A1 * | 9/2007 | Salvestrini | 363/125 |
| 2008/0024074 | A1 * | 1/2008 | Mosebrook et al. | 315/291 |
| 2009/0108765 | A1 * | 4/2009 | Weightman et al. | 315/224 |

FOREIGN PATENT DOCUMENTS

WO WO-2009/109032 A1 9/2009

* cited by examiner

*Primary Examiner* — Minh D A
(74) *Attorney, Agent, or Firm* — Haynes and Boone, LLP

(57) ABSTRACT

A method and apparatus are provided for operating a control switch. In one embodiment, the control switch includes an input terminal coupled to an alternating current (AC) power supply, a load terminal coupled to a load, a triac circuit coupled to the input terminal and the load terminal, a microcontroller and a power supply. The triac circuit may be configured to receive a triggering voltage and provide an activation pulse to the load based on one or more triggering voltage signals supplied by the microcontroller. In another embodiment, the power supply may be configured to step down AC power received from the input terminal and supply line voltage to the microcontroller.

20 Claims, 8 Drawing Sheets

-Prior Art-

708
Terminal
Voltage (V)
Triac
Activation
709
711
713

715
Terminal
Voltage (V)

CONTROL SWITCH

FIELD OF THE INVENTION

The invention relates generally to switching circuits and more particularly to an apparatus and method for operating a control switch.

BACKGROUND

Home automation systems have been developing for many years. Conventional applications for such systems include control of lighting, heating ventilation air conditioning (HVAC), garden sprinklers, intelligent alarm systems etc. Wireless home automation systems have gained popularity in recent years due to the relative ease of installation in comparison to many hardwired systems. Many wireless home automation systems are aimed at Do-It-Yourself customers as wireless devices that are not operated by battery only need wiring for power. The most popular application for wireless home automation system is lighting control. Among lighting control devices, wall switch controlled lighting devices are the most popular. These switches are widely used in both residential and commercial buildings alike. A conventional method for converting a traditional wall switch to be controlled wirelessly requires a wall switch module. Such wall switch modules can replace existing wall switches.

For a conventional wall switch module, power may be supplied by existing wiring in an electrical switch box. In general, only two wires are fed into an electrical switch box, a live feed from the AC power supply to the switch and a wire extending from the switch to the load. In most cases, the other side of the load is connected directly to the neutral of the AC power supply without returning to the switch box. FIG. 1 illustrates a circuit diagram of a conventional wall switch. As shown in FIG. 1, switch 101 is connected to live terminal 103 of an AC power supply and load 105, in this instance a light bulb. Neutral 107 is connected to the other terminal of load 105 and is not located inside the wall switch box. Most electrical systems include an earth ground connection 109 to the electrical switch box containing the switch 101, mainly for safety considerations and to satisfy electrical code requirements.

Some conventional electrical switch boxes are only provided with a live feed to supply the wall switch. As a result, a neutral connection may not be provided to complete the circuit with the electrical switch box. For existing structures, it may be very costly to run neutral connections to electrical switch boxes when a neutral wire is not initially installed due to limited access to the existing wiring. Therefore, there is a need for a wall switch module that can operate using existing wiring in an electrical switch box without a neutral connection.

Conventional devices and methods to provide lighting control products for wall switch control without a neutral connection are available, but are limited in operation. For example, one conventional approach is based on a wall switch module simulating a load, wherein the load changes depend on the status of the connected load. When the lighting fixture is off, internal impedance of the wall switch may become very high in comparison to the lighting fixture. This may result in a decrease in current through the wall switch internal load which causes the lighting fixture to be off. If the lighting fixture is turned on, the wall switch internal impedance may become much less than the impedance of the lighting fixture and can result in enough power to turn on the fixture. One major limitation with this approach is that the actual connected load must be incandescent loading, such as a tungsten light bulb. This conventional method will not work with compact fluorescent lamps (CFL) or fluorescent lighting. CFL exhibit a very high impedance when a lighting fixture is turned off, which is also much higher than incandescent lamps. Thus, conventional wall switch control devices and methods without a neutral connection do not provide enough current to operate the electronic circuitry inside the wall switch control module. An additional drawback is that some countries have proposed rules that will ban tungsten bulbs from the marketplace in the near future. Therefore, there is a need for a wall switch control module that operates CFL and/or fluorescent light.

Conventional electrical switch boxes additionally fail to distinguish between different types of loads. For example, a conventional method to control brightness for an incandescent load, such as dimming or brightening the light bulb, employs triac output control. The conventional triggering methods for incandescent loads, however, may not be suitable for CFL loads. For example, the conventional methods for triggering an incandescent load may not be able to turn on CFL load properly and may result in undesired flashing. Thus, the aforementioned conventional method for triac control is further not suitable as most CFL loads are non-dimmable.

Thus, there is a need for a control switch to provide one or more of detection of the connected load (e.g., incandescent load and CFL load), a control switch which can block and/or limit dimming operation to on and off only depending on load type and different triac operation for different loads.

BRIEF SUMMARY OF THE INVENTION

Disclosed and claimed herein are an apparatus and methods for operating a control switch. In one embodiment, a control switch includes an input terminal coupled to an alternating current (AC) power supply, a load terminal coupled to a load, and a triac circuit coupled to the input terminal and the load terminal. The triac circuit includes a gate terminal configured to receive a triggering voltage and is configured to provide an activation pulse to the load based, at least in part, on the received triggering voltage. In another embodiment, the control switch includes a microcontroller electrically coupled to the gate terminal and configured to provide one or more triggering voltage signals to the gate terminal. The control switch further includes a power supply configured to step down AC power received from the input terminal and supply line voltage to the microcontroller. In that fashion the control switch may supply power to control circuitry when power is not supplied to a load despite the lack of a neutral connection. Accordingly, the control switch may be used for home automation and/or other types of control.

In another embodiment, a method for determining a type of load by a control switch includes firing a triggering voltage to trigger a gate terminal of a triac circuit, and determining the type of load by a detection circuit of the control switch. As will be discussed in more detail below, different voltages may be applied for different types of loads by the control switch. In a further embodiment, a method for triggering of a control switch includes firing multiple triggering pulses, by the microcontroller, to trigger a gate terminal of a triac circuit a plurality of times, and monitoring an activation state of a load by the microcontroller.

Other aspects, features, and techniques of the invention will be apparent to one skilled in the relevant art in view of the following detailed description of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF EXEMPLARY EMBODIMENTS

Figure 1:
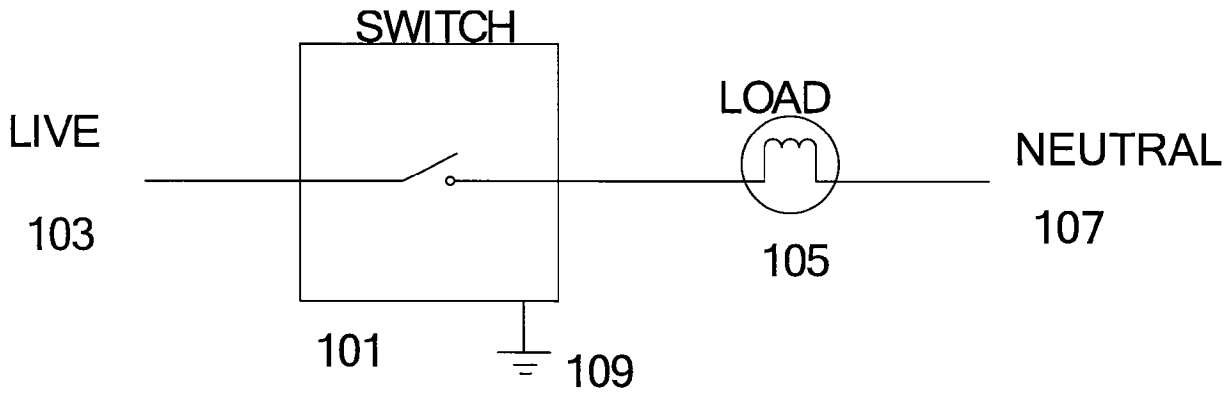
FIG. 1 is a circuit diagram of a conventional wall switch.

One aspect of the present invention relates to a control switch including a power supply. Unlike typical control switches, a power supply of the control switch can supply power to a microcontroller and/or other components of the control switch without a connection to neutral wiring. Because many wall switch connections may not provide neutral wiring to an electrical box, it may be difficult to get power for electronic circuitry to run when power is not applied to a load (e.g., a light control switch in the off position). Accordingly the present invention allows for control circuitry to operate regardless of power applied to a load without a neutral connection. Further, a power supply of the control switch allows for remote operation and/or use of the control switch in a home automation system.

In one embodiment, the control switch may be configured as a wireless wall switch. The wall switch may include a control circuit to supply power to a load controlled by the switch. According to another embodiment, the control circuitry may include a power supply to provide power for the control circuitry, such as a microcontroller, wireless receiver and load detection circuitry. In another embodiment, the wall switch may be configured to receive one or more control signals wirelessly. In yet another embodiment, the control switch may be provided for wireless home automation.

According to another embodiment, a control switch may be configured to determine a type of load (e.g., incandescent and/or CFL loads) and control operation of the load based on the determined type. Input threshold voltages of CFL loads can require increased voltages levels for activation in comparison to incandescent loads. In one embodiment, a method is provided for detecting a type of load by a control switch to allow for proper activation of the load. The method may include firing a triggering voltage to trigger a gate terminal of a triac circuit by the microcontroller and determining the type of load by a detection circuit of the control switch of a control switch for operation of a load.

In another embodiment, a method is provided for triggering of a control switch wherein multiple firing pulses are fired to ensure activation of a load. As will be discussed in more detail below with respect to FIG. 5, delaying a triggering pulse can provide an increased activation voltage for an activation pulse. In another embodiment, a first pulse and a second delayed pulse may be provided to increase input voltage in order to exceed the input threshold voltage of particular loads (e.g., CFL load). In one embodiment, a method for triggering a control switch includes firing multiple triggering pulses to trigger a gate terminal of a triac circuit a plurality of times by the microcontroller and monitoring an activation state of a load by the microcontroller. The multiple triggering pulses may be fired during each half cycle. The control may further be configured to suspend firing of activation pulses when the load is detected as activated.

Figure 2:
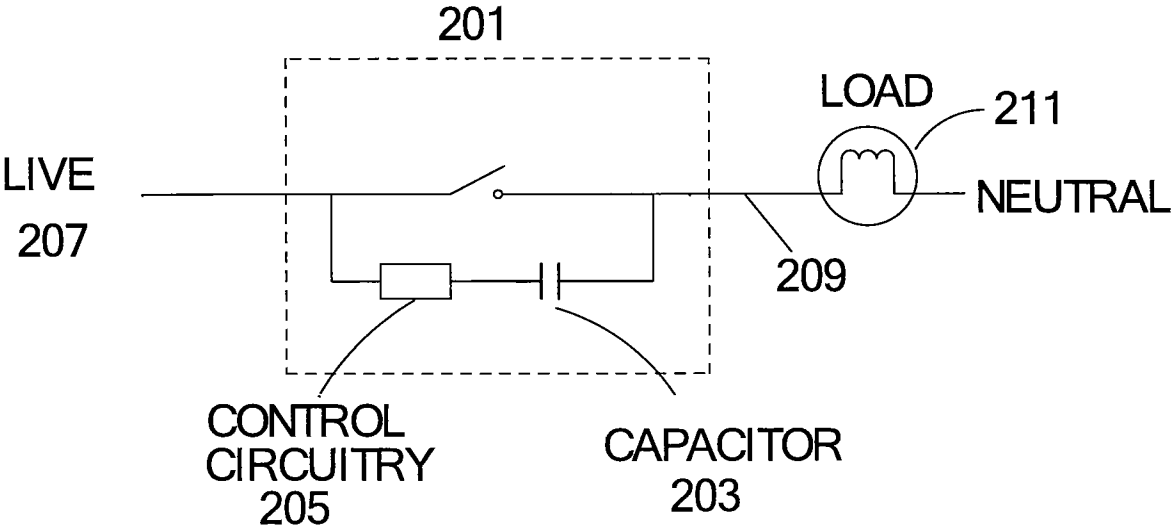
FIG. 2 is a simplified circuit diagram of a control switch according to one embodiment of the invention.

Referring now to the figures, FIG. 2 depicts a control switch according to one embodiment of the invention. As shown in FIG. 2, control switch 201 includes capacitor 203 and control circuitry 205. Control switch 201 further includes terminal 207 coupled to a live source to receive alternating current (AC) power and load terminal 209 coupled to load 211 (shown as an incandescent light). In one embodiment, control switch 201 may be used to replace a conventional switch (e.g., switch 101). Control switch 201 may further be configured to supply power to control circuitry 205 when load 211 is off. Control circuitry 205 may further be configured to include and/or function for triac control, provide a microcontroller, a wireless signal receiver, a switching power supply, etc.

In one embodiment, control switch 201 may relate to a wireless control switch for operation of load 211 including use by a home automation system. Although load 211 is shown as an incandescent light, it may be appreciated that control switch 201 may be employed to control at least one of a HVAC device, sprinkler and automated devices in general.

In another embodiment, capacitor 203 may be employed to function as a current limiting capacitor. Capacitor 203 may function as a current limiter to control current draw within acceptable limits for operation of a load. By way of example, if the current draw becomes too high, load 211 can be completely or partially turned on which can result in undesired flashing. Therefore, capacitor 203 may be set to control how much current is flowing thru load 211. Typical maximum current draw for a CFL load is around 100 uA. In certain cases a CFL load will not respond when the maximum current draw is exceeded. If the current draw is above 100 uA, some CFL loads will start to flash. Therefore, capacitor 203 may function as a current limiter to control current draw.

In certain instances, 100 uA may not be sufficient to maintain the operation of control circuitry, such as a microcontroller, wireless receiver and/or other peripheral circuitries etc. Therefore, control circuitry 205 may include a power supply, such as a switching mode power supply according to one embodiment. The power supply may be configured to step down voltage from the AC line voltage (i.e. 120V AC in North America) to a much lower DC voltage which is sufficient to power control circuitry, around 10V DC. By stepping down the voltage with a switching power supply, current may also be stepped up by the same ratio. As a result, a power supply of control circuitry 205 can increase the current from 100 uA to 1200 uA (1.2 mA) in one exemplary embodiment (a ratio of 12 times). Thus, a power supply of control circuitry 205 may convert the maximum allowable current draw of 100 uA to a level able to operate the remaining control circuitry.

Figure 3:
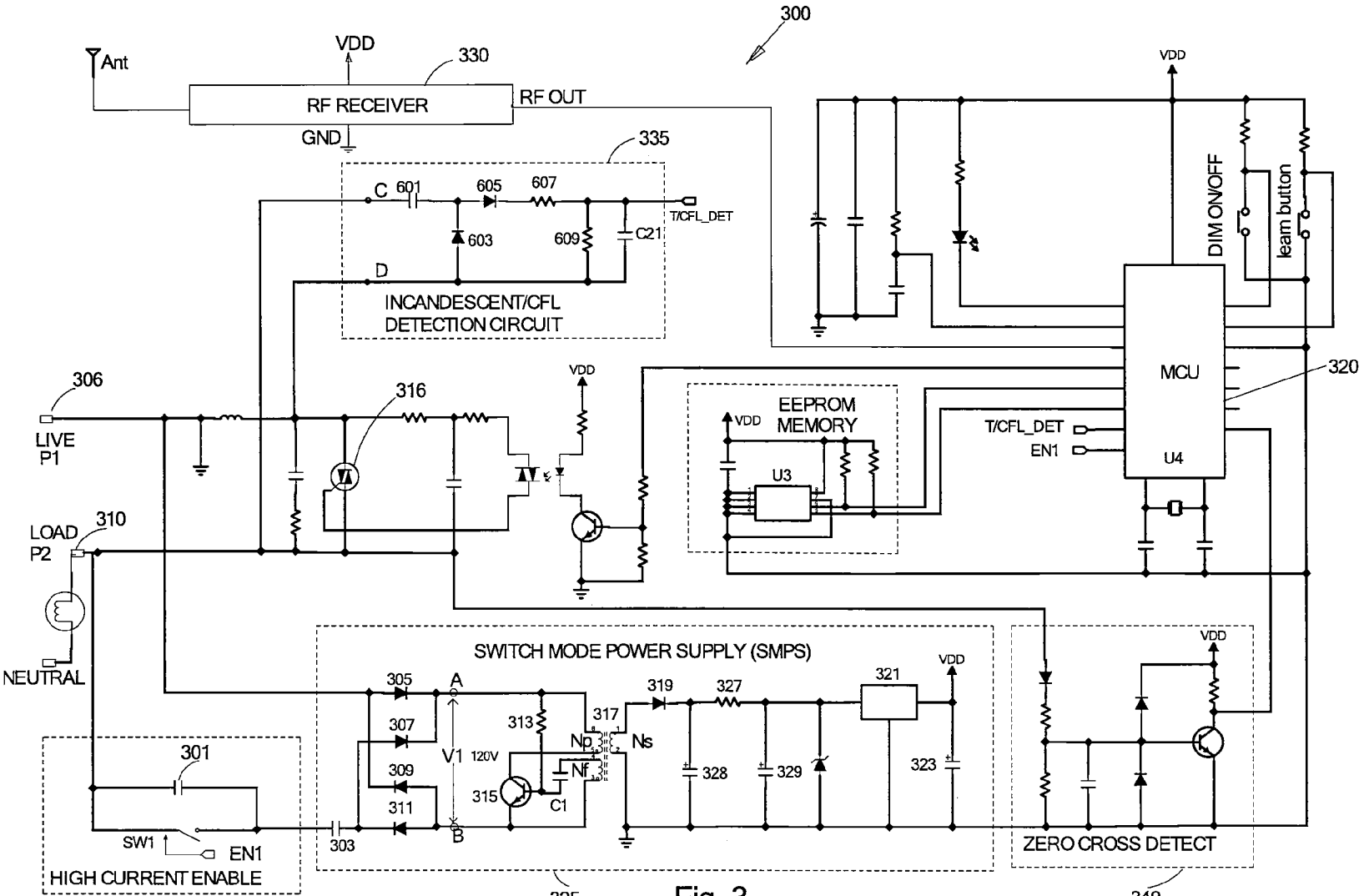
FIG. 3 is a circuit diagram of a control switch according to one embodiment of the invention.

Referring now to FIG. 3, a circuit diagram is shown of a control switch (e.g., control switch 201) according to one embodiment of the invention. Control switch 300 includes first terminal 306 configured to receive AC power and second terminal 310 coupled to a load. A triac circuit including triac 316 is coupled to terminals 306 and 310. A gate terminal of triac 316 is electrically coupled microcontroller 320 and configured to receive a triggering voltage. Triac 316 may be configured to provide an activation pulse to the load based, at least in part, on the received triggering voltage. Control switch 300 additionally includes current limiting capacitor 301. Current limiting capacitor 301 may be employed to limit current draw and allow for operation of a load while allowing for increased current for control circuitry. In certain embodiments, microcontroller 320 may be configured to bypass current limiting capacitor 301 by shorting the capacitor.

Microcontroller 320 may be configured to provide one or more triggering voltage signals to the gate terminal of triac 316 based on one or more signals received from radio frequency (RF) receiver 330 and/or zero cross detection circuit 340. For example, a user may transmit one or more commands for to operate a load coupled to control switch 300. Control switch 300 further includes power supply 325 coupled to terminals 306 and 310, power supply 325 configured to step down AC power received from terminal and supply line voltage to the microcontroller.

Power supply 325 is shown as a switched mode power supply and relates to a switching power supply with ferrite transformer according to one embodiment. In another embodiment, when voltage is applied through the current limiting capacitor 301, capacitor 303 and the bridge rectify diodes 305, 307, 309, 311, a DC voltage V1 will be generated at the terminal A-B and biasing current will then pass through resistor 313. The bias current turns on transistor 315 and voltage V1 will be applied to primary winding Np of transformer 317 through transistor 315. Feedback winding Nf, with opposite phase to Np, of power supply 325 can induce a voltage which is proportional to the turn ratio of Np and Nf. The induced voltage will increase the collector current and keep transistor 315 in an on state. Because the secondary winding of transformer 317 is in opposite phase with Np winding, diode 319 will be cut off and no current will be passing to the voltage regulator 321, such that the electrical energy will be stored in the form of magnetic energy in transformer 317 during the period when transistor 315 is on. At the same time, capacitor 323 will start charging until transistor 315 changes from on state to a cut off state, then diode 319 will start to conduct and the magnetic energy stored in transformer 317 will be transform to electric current and then passing through the low pass filter capacitors 328, 329, resistor 327 and then through the voltage regulator and supply the necessary current and voltage to the microprocessor and other control circuitry.

One advantage of employing a switching power supply by control switch 300 over a resistor or capacitor to step down the high AC voltage to a much lower DC voltage may be reduced loss of power. Another advantage may include conversion of the majority of the electrical power from higher voltage-low current, to low voltage-high current to allow for operation of the control circuitry (e.g., control circuitry 205). It should also be appreciated, however, that other types of power supplies may be employed by control switch 300.

According to another embodiment, control switch 300 may be configured to control timing for pulse firing to activate a triac circuit. The control switch may further be configured to determine a type of load, such as incandescent or CFL, by firing a triac circuit during different time periods.

As shown in FIG. 3, terminals C and D are connected to triac 316. Detection circuitry 335 of control switch 300 may be configured to monitor the average voltage across triac 316. When triac 316 is triggered, the voltage across terminals C and D will be coupled to components of detection circuitry 335 as described in more detail below with reference to FIG. 6. The output of detection circuitry 335 may be output to microcontroller 320 to determine the type of load and/or activation state of the load.

Figure 4:
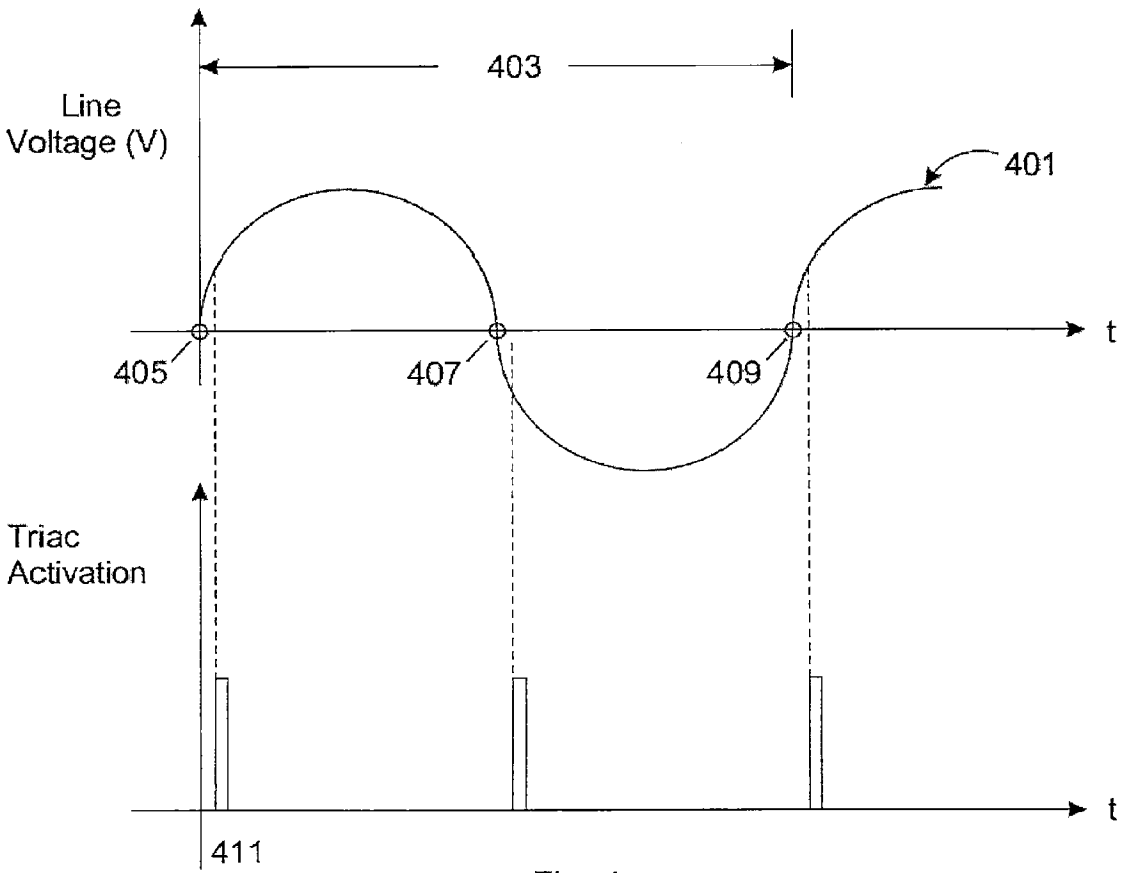
FIG. 4 is a graphical representation of received line voltage and triac activation pulses according to one embodiment of the invention.

Referring now to FIG. 4, a graphical representation of line voltage received by a terminal (e.g., terminal 207) of a control switch and triac activation pulses are shown according to one or more embodiments. AC signal 401 exhibits period 403 of 1/60 of a second and relates to signal frequency of 60 Hz. It should be appreciated that AC signal 401 may relate to other frequencies which may be carried by a feed coupled to the live terminal. In one embodiment, the control switch (e.g., control switch 201) can activate a pulse after detecting the zero crossing half cycle, as indicated by 405, 407 and 409. Activation pulse 411 may be a characterized as having a duration of approximately 100 us. For incandescent loads, firing a pulse after a zero crossing would be sufficient to turn on the load. However, firing pulse 411 will not be able to turn on most CFL loads as CFL loads generally exhibit a higher input threshold voltage. Thus, CFL and/or other loads may require an activation pulses with an increased activation voltage.

Figure 5:
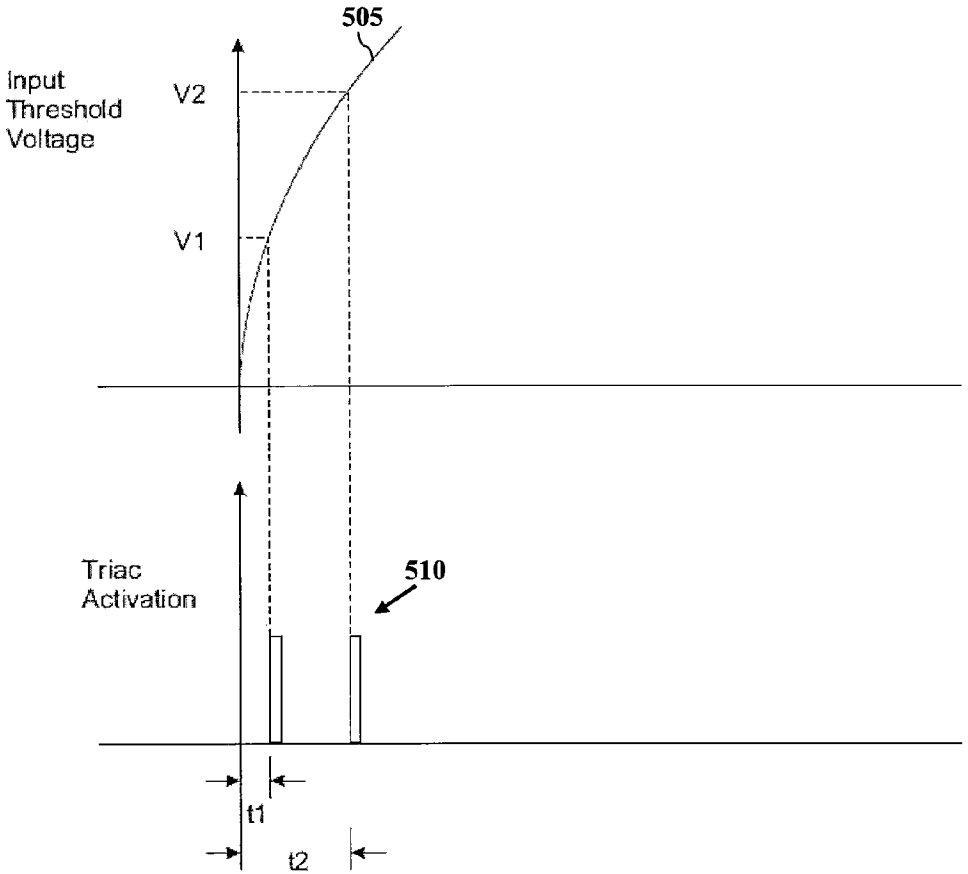
FIG. 5 is a graphical representation of input threshold voltage and triac activation pulse according to one embodiment of the invention.

Referring now to FIG. 5, a graphical representation is shown of input threshold voltage and triac activation pulse are shown according to one or more embodiments. In one embodiment, input threshold voltage 505 is the resulting voltage when a pulse is fired by the triac. In certain embodiments, control switch 300 can fire pulse 510 at time t1 with voltage at V1 to activate an incandescent load. However, if the load is a non-incandescent load, such as a CFL, firing the triac at V1 by control switch 300 may not provide a high enough threshold voltage to activate the load. According to one embodiment of the invention, an input voltage V2 must be applied in order to activate the non-incandescent load. Thus, control switch 300 may be configured to fire pulse 510 when the AC voltage is higher (i.e. wait longer until the voltage rises to certain voltage, at t2, which provides V2 as the input threshold voltage) to turn on the CFL load instead of firing a pulse almost immediately after zero crossing at t1. It may also be appreciate that the microcontroller of the control switch may be configured to adjust delay of activation pulses.

According to another embodiment of the invention, the input threshold voltage of level of a load may be used to determine whether the load is incandescent or CFL. In one embodiment, control switch 300 can activate a pulse when the input threshold voltage is very low (i.e. immediately after zero crossing) and determine whether the load is turned on or not. If the load is incandescent, firing the low voltage pulse will turn on the load, and the voltage across the triac will be very low as most of the energy is being used to turn on the load. According to another embodiment, firing a low voltage pulse will not turn on the load if the load is not incandescent, and the average voltage across triac 316 will then be much higher because the load is not drawing the rated power. Therefore, by observing the average voltage across triac 316 after a zero crossing pulse activation, the load can be determined as one of an incandescent load and non-incandescent load.

Figure 6:
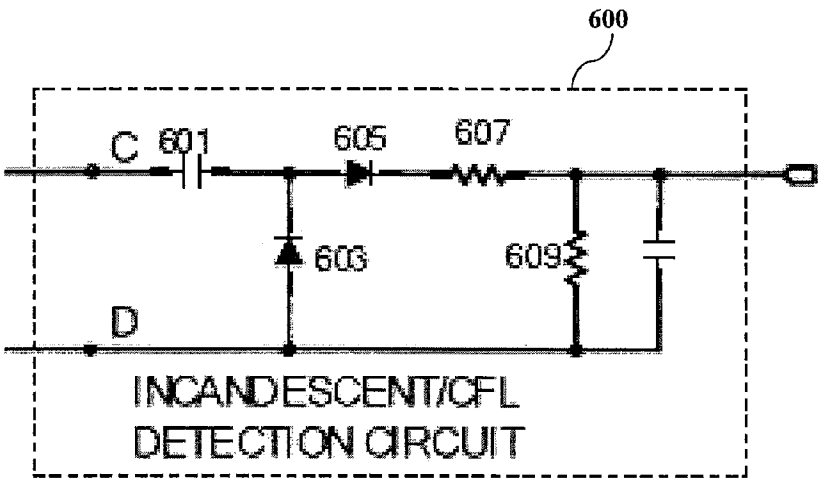
FIG. 6 is a simplified diagram of a detection circuit according to one embodiment of the invention.

Referring now to FIG. 6, a circuit diagram is shown of detection circuitry 335 of FIG. 3. Detection circuit 600 may be configured to monitor the average voltage across triac 316 of control switch 300. The output of detection circuitry 600 is output to microcontroller 320 to determine the type of load and/or activation state of the load. In one embodiment, when triac 316 of the control switch is triggered, voltage across terminals C and D is coupled through capacitor 601 and rectified by diodes 603 and 605 to become a DC voltage. Resistors 607 and 609 may be configured to step down the voltage from the AC line voltage to an acceptable input level for microcontroller 320 (e.g., below 5V DC). The output signal from detector circuitry 600 may be directly coupled to microcontroller 320. If the output voltage from detector circuitry 600 is above 1/3 of the operating voltage (i.e. 5V), microcontroller 320 will consider the load as off (average voltage across the terminals is high). If the output voltage from detector circuitry 600 is below ⅓ of the operating voltage, microcontroller 320 will consider the load as on (average voltage across the terminals is low).

According to another embodiment of the invention, a control switch may be configured for firing multiple pulses of the triac circuit. Threshold voltages may be different for various non-incandescent loads and it may be difficult to predict when a pulse should be fired by a control switch. For example, if the pulse is fired too early (lower input threshold voltage), the load may not be turned on. Alternatively, if the pulse is fired too late (higher input threshold voltage), the overall brightness of the load will be reduced resulting in a dimming effect. In one embodiment, instead of firing a triggering pulse once at a fixed threshold voltage, a control switch according to the invention may be configured to fire the multiple pulses at various threshold voltages. One advantage to firing multiple pulses may be activation of the load at a maximized brightness level.

Figure 7A:
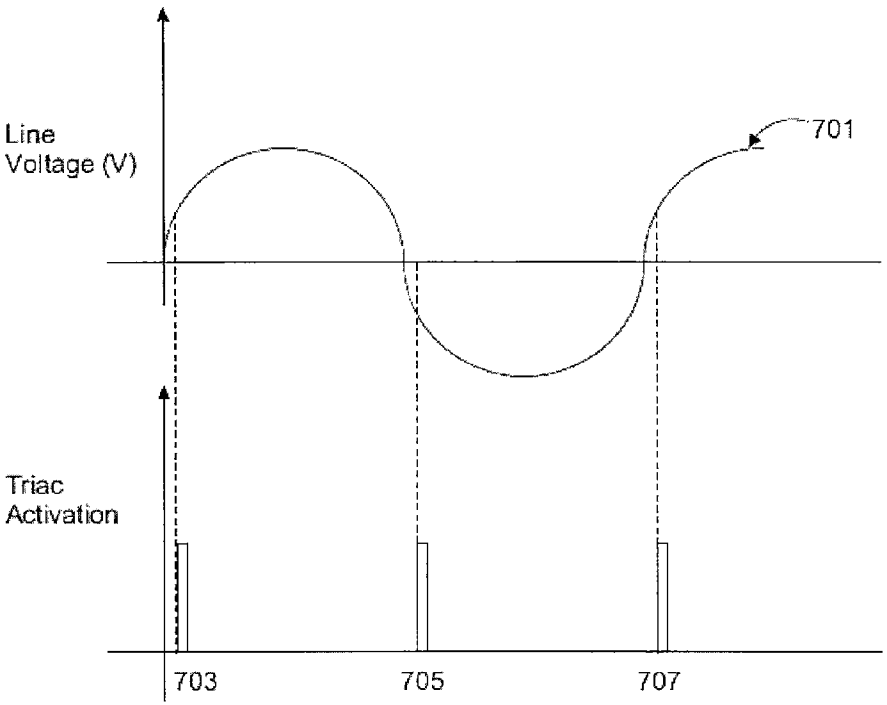
FIGS. 7A-7C depict graphical representations of voltage signals and triac activation pulses according to one or more embodiments of the invention.
Figures 7B, 7C:
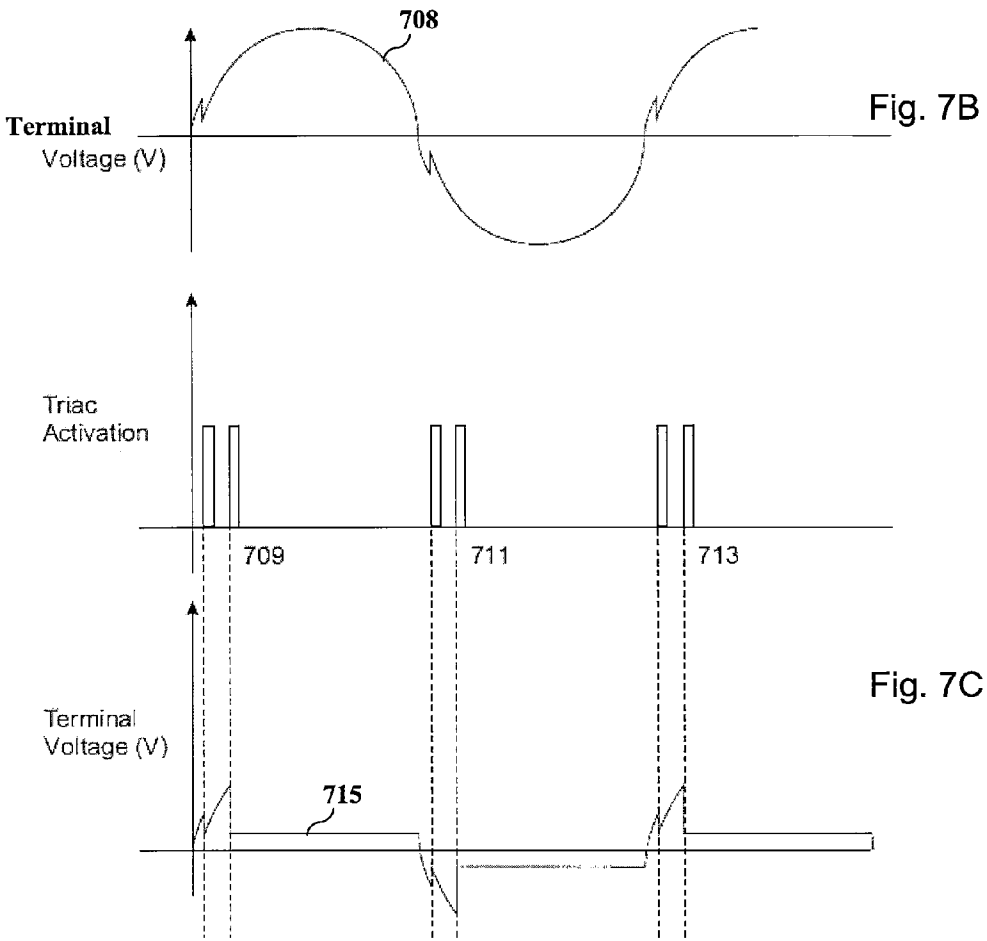

Referring now to FIGS. 7A-7C, a graphical representation of voltage levels and triac activation pulses are illustrated according to one or more embodiments of the invention. In one embodiment, multiple triggering pulses can be applied to a triac circuit (e.g., triac 316) for various types of loading and/or different input threshold voltages. The control switch (e.g., control switch 300) may be configured to monitor a load while voltage is applied to the load if the voltage across the triac is below a certain level. As a result, the triac can be activated multiple times until the load is activated. As shown in FIG. 7A, signal 701 relates to a typical AC input signal characterized by a frequency of 60 Hz. According to one embodiment of the invention, the control circuitry of the control switch may fire activation pulses 703, 705, 707 immediately after a zero crossing.

FIG. 7B illustrates terminal voltage when a load is not activated. As shown, voltage signal 708 is still very high and therefore the load cannot be turned on. Referring now to FIG. 7C, a graphical illustration is shown for terminal voltage when multiple activation pulses are fired. As shown in FIG. 7C, a pair of consecutive activation pulses, shown as 709, 711 and 713, may be fired after each zero crossing. In one embodiment, multiple pulses are fired each half cycle. In accordance with one embodiment of the invention, the load may now be activated after the second activation pulse on each cycle. As shown by terminal voltage signal 715, once the load is activated, the terminal voltage across the triac drops significantly. A detection circuit (e.g., detection circuit 335) may provide the terminal voltage to the microcontroller (e.g., microcontroller 320) and the microcontroller can terminate triac activation until the next cycle to prevent the triac circuit from continued firing of activation pulses.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinary skilled in the art.

What is claimed is:

1. A control switch comprising:

an input terminal coupled to an alternating current (AC) power supply;

a load terminal coupled to a load;

a triac circuit coupled to the input terminal and the load terminal, the triac circuit comprising a gate terminal configured to receive a triggering voltage, wherein the triac circuit is configured to provide an activation pulse to the load based, at least in part, on the received triggering voltage;

a microcontroller electrically coupled to the gate terminal wherein the microcontroller is configured to provide one or more triggering voltage signals to the gate terminal; and a power supply coupled to the input terminal, the load terminal and the microcontroller, wherein the power supply is configured to step down AC power received from the input terminal and supply line voltage to the microcontroller.

2. The control switch of claim 1, wherein the microcontroller is further configured to provide multiple triggering voltage signals to the gate terminal during each half of an AC power supply cycle.

3. The control switch of claim 1, wherein the microcontroller is further configured to provide the one or more triggering voltage signals to provide multiple power output levels by the triac circuit.

4. The control switch of claim 1, wherein the power supply is further configured to supply line voltage to the microcontroller when power is not supplied to the load.

5. The control switch of claim 1, further comprising a receiver circuit coupled to the microcontroller, the receiver circuit configured to wirelessly receive one or more control signals for controlling power to the load.

6. The control switch of claim 1, further comprising a load detection circuit coupled to the input terminal and the load terminal, the load detection circuit configured to determine a type of load based on the triggering voltage.

7. The control switch of claim 6, wherein the load detection circuit is configured to detect one or more of a compact fluorescent lamp (CFL) and incandescent light.

8. The control switch of claim 6, wherein the microcontroller is configured to adjust timing of a triggering signal based on a determined type of load.

9. The control switch of claim 1, further comprising a current limiter electrically coupled to the input terminal and the microcontroller, the current limiter configured to limit the current draw through the load.

10. A method for determining a type of load by a control switch comprising the acts of:

receiving, by an input terminal of a control switch, alternating current (AC) power from an AC power supply;

stepping down the AC power supply, by a power supply, to supply line voltage to a microcontroller;

firing a triggering voltage, by the microcontroller, to trigger a gate terminal of a triac circuit; and determining the type of load, by a detection circuit, based in part on the trigger voltage.

11. The method of claim 10, wherein the type of load is determined based on an average voltage level of the triac circuit.

12. The method of claim 10, wherein the type of load relates to one of a compact fluorescence lamp (CFL) and an incandescent light.

13. The method of claim 10, further comprising adjusting triggering of the triac circuit, by the microcontroller, based on the type of load determined.

14. The method of claim 10, further comprising firing multiple triggering voltage signals, by the microcontroller, to the gate terminal for each half of an AC power supply cycle.

15. A method for triggering of a control switch comprising the acts of:

receiving, by an input terminal, alternating current (AC) power from an AC power supply;

stepping down the AC power supply, by a power supply, to supply line voltage to the microcontroller;

firing multiple triggering pulses, by the microcontroller, to trigger a gate terminal of a triac circuit a plurality of times; and monitoring an activation state of a load by the microcontroller.

16. The method of claim 15, wherein the multiple triggering pulses are fired to provide varying power output levels to the load.

17. The method of claim 15, wherein monitoring an activation state of a load comprises determining an average voltage level of the triac circuit.

18. The method of claim 15, further comprising determining a load type, by a detection circuit, based on an average voltage level of the triac circuit.

19. The method of claim 18, wherein the type of load relates to one of a compact fluorescence lamp (CFL) and an incandescent light.

20. The method of claim 18, further comprising adjusting triggering of the triac circuit, by the microcontroller, based on the type of load determined.

* * * * *